United States Patent [19]

Megna

[11] Patent Number: 4,934,387

[45] Date of Patent: Jun. 19, 1990

[54] HAIR EXTENSION PROCESS

[76] Inventor: Salvatore Megna, 8240 Belvedere Suite E, Sacramento, Calif. 95826

[21] Appl. No.: 347,767

[22] Filed: May 5, 1989

[51] Int. Cl.[5] ..... A41G 3/00

[52] U.S. Cl. ..... 132/201; 132/56

[58] Field of Search ..... 132/53, 56, 201

[56] References Cited

U.S. PATENT DOCUMENTS

| | | | |
|---|---|---|---|
| 1,831,801 | 11/1931 | Birk | 132/53 |
| 2,621,663 | 12/1952 | Jenkins | 132/201 |
| 3,295,534 | 1/1967 | Dorkin | 132/201 |
| 4,372,330 | 2/1983 | Nelson | 132/201 |

*Primary Examiner*—John J. Wilson
*Assistant Examiner*—Frank A. LaViola, Jr.
*Attorney, Agent, or Firm*—Mark C. Jacobs

[57] ABSTRACT

A process for lengthening the hair of persons having short hair and for thickening the hair for those having a relatively snall amount of hair, which process comprises the steps of aligning supplemental hair with the natural hair, adhering the supplemental hair to the natural hair utilizing a colored thermpolastic glue, intertwining the warm adhered natural and supplemental hair together to permit a binding of the supplemental to the natural hair, and then styling the combined hair. A technique for preparing the thermoplastic glue is also disclosed.

15 Claims, 1 Drawing Sheet

HAIR EXTENSION PROCESS

BACKGROUND OF THE INVENTION

In the late 1980's women find that they have less and less time to spend on their hair due to the requirement for the second income. Due in part to the increased stress of the workaday world, more women are experiencing thinning of their hair, or broken ends so they keep their hair short even though secretly they may desire longer hair.

Studies have also shown that there has been a significant increase in romance at the office due to the lack of time for people of both sexes to meet potential mates in a social environment. Thus women find it necessary to look their best far more often than in the recent past. For these reasons women are turning more and more to full and partial appearance make overs.

One of the easiest ways to change one's appearance and outlook is the changed hairdo. For many women with thinning hair or with short hair but with the desire for long hair, the answer is the improved hair extension process of this invention. The extension technique adds strand or tufts of hair to the current strands of natural hair of the user. The technique, whether used for the lengthening of the natural hair or for the thickening of thinning hair, is basically the same.

Up till now however, this technology has been cumbersome, and has not yielded satisfactory results due to the nature of the process and the materials employed in the process for attaching the supplemental hair to the natural hair. There is a need therefore for an improved process for attaching supplemental hair to a person's natural hair.

It is one object of this invention to provide a new process for extending the length of human hair.

It is another object to provide a simplified process for thickening the natural hair of a person, preferably a woman.

Still another object is to provide an improved adhesive and the process for making same for use in hair extension technology. Other objects of the invention will in part be obvious and will in part appear hereinafter.

The invention accordingly comprises the several steps and the relation and order of one or more of such steps with respect to each of the others, and the product possessing the features and properties which are exemplified in the following detailed disclosure and the scope of the application of which will be indicated in the claims appended hereto.

For a fuller understanding of the nature and objects of the invention, reference should be had to the following detailed description taken in connection with the accompanying drawings.

SUMMARY OF THE INVENTION

The instant process pertains to the lengthening of natural hair by the use of supplemental hair extensions and/or to the thickening of the natural hair by addition of supplemental hair strands. The steps of lengthening and adding are the same, the only difference in the two procedures pertains to the location of the junction on the head relative to the length of the strands of natural hair in different areas.

Supplemental hair is adhered to the natural hair by the use of a colored thermoplastic glue, and then intertwined and bound together, followed by a styling of the combined hair.

DESCRIPTION OF THE PREFERRED EMBODIMENT

Prior to referring to FIGS. 1–5, a brief discussion of the mode of preparation of the adhesive for use therein is in order. Thermoplastic glues such as are used in hot glue guns are well known and are readily available in the marketplace from such makers as USM among others. This glue which has a low melting point and a quick solidification is generally available in shades of off-white to tan. Chemically thermal hot melt glues can be polyamide based as well as cellulose polyesters and cellulose polyethers. I have found that this material can be melted in bulk and suitably colored utilizing readily available tempera coloring material. Tempera colors are sold by such vendors as Custom Building Products and many other art supply vendors, in a ground powdered format. I have found that suitable browns, blacks, auburns, and other natural and dyed hair colors can be prepared by the mixing from 2 teaspoons to 2 grams parts of a tempera color with 1 gallon to 2 gallons of thermoplastic glue melt. The powder additive is mixed in and thoroughly blended in a heated vessel. Once colored uniformly, the glue can be poured or injected into suitable molds and allowed to harden for use with the standard glue gun.

Turning now to the drawings.

Figure 1:
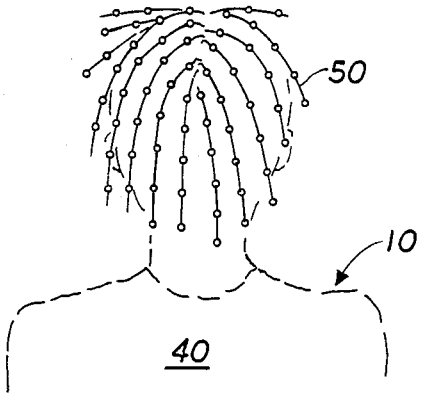
FIG. 1 is a rear elevational view of the hair and shoulder area of a female human.
Figure 2:
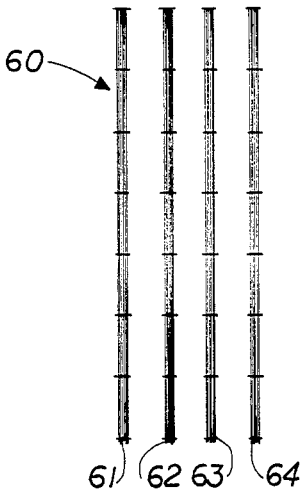
FIG. 2 is a closeup magnified view of tufts of supplemental hair.

FIG. 1 illustrates the rear of the head of a person who suffers from short and thinning hair. It is called to the readers attention, that the number of strands or tufts of hair shown herein and the size of such strands or tufts are not to scale and are exaggerated for ease of understanding of this invention. Normally, the amount in each tuft of supplemental hair ranges from 150 to 300 individual hairs for each extension site. Thus in FIG. 1 customer 10 has a body 40 with a head of hair 50. For ease of illustration, the hair of the customer is shown schematically in a circle and line format whereas in FIG. 2, the supplemental hair is shown in a different format comprising lines alternately positioned 90 degrees to each other. In FIG. 2, designator 61 through 64 pertain to individual tufts of supplemental hair.

Figure 3:
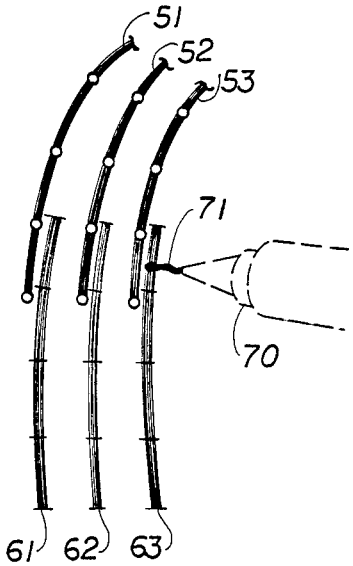
FIG. 3 is a diagrammatic view illustrating the alignment of supplemental hair tufts adjacent to natural hair tufts and the ejection of a dab of a glue from a hot melt glue gun.

FIG. 3 illustrates diagrammatically the placement of three tufts of pre-prepared supplemental hair 61, 62 and 63. The mode of pre-preparing the supplemental hair is discussed below. Adjacent natural hair tufts 52 through 53 inclusive spaced up the distal ends of the natural hair and spaced down from the proximal end of the supplemental hair. Thus as can also be seen in FIG. 2, a portion of the supplemental extends past the length of the natural hair. To the right of the illustration a standard glue gun 70 is seen to be emitting a dark heated portion 71 of colored thermoplastic glue.

Figure 4:
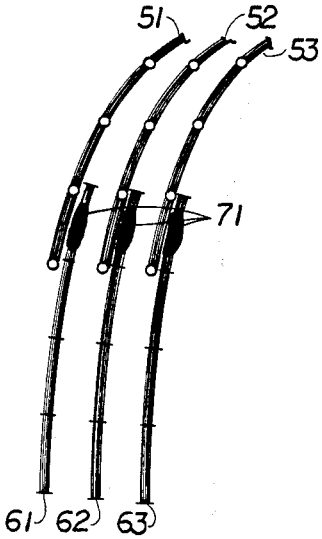
FIG. 4 is a closeup magnified view of the combined natural and supplemental hairs of FIG. 3 after the dab of glue has been applied to the aligned hairs.

FIG. 4 shows the placement of the portion 71 of glue at the terminal ends of the tufts of natural and supplemental hair.

Figure 5:
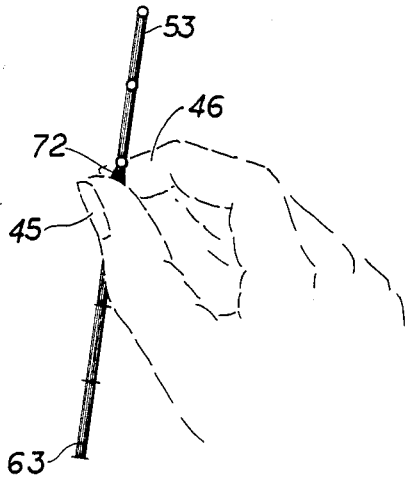
FIG. 5 is a diagrammatic view illustrating the rolling of the adhered hair between the forefinger and thumb while the adhesive is still soft.
Figure 7:
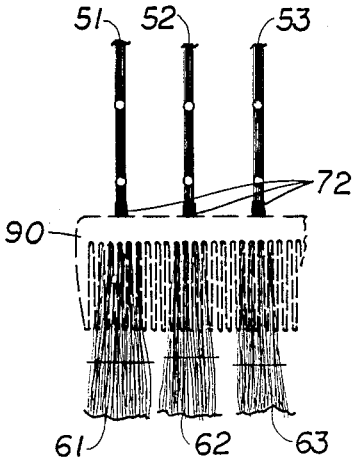
FIG. 7 illustrates diagrammatically the combing of the extended hair.

The next step, in the process of lengthening or thickening the hair is shown in FIG. 5. Prior to the solidification of the glue portion 71 the operator moves his or her thumb 45 and forefinger 46 to bind or roll together the adhered tufts or tufts of hair such that they become meshed together. Note carefully the relative placement of the tufts shown previously in FIG. 4 in numerical order from left to right, as now seen in FIG. 5. While the colored thermoplastic glue is slightly warm, it is still pliable prior to full solidification such that the portion can be squeezed down between the fingers to form a dab of mixture of meshed together hair and hardened glue. As is seen in the drawing, which is also not to scale; namely FIG. 7, the now hardened dab of glue held hair extension is combed through a comb 90, in a manner to cause natural hair to overlie the glue junction 72 which can be seen as significantly smaller and less visible than the big relatively large size portion 71. In conventional styling techniques, the dab of colored glue can be made invisible to the viewer looking at the surface of the hair.

Having discussed the procedure in brief relating to the drawings. It is believed that a textual discussion will further explain the details of the process. The following procedure represents an organized plan of attachment to accomplish hair extension.

Begin by preparing the hair in a shampooing procedure using an extremely cleansing shampoo to strip away any natural oil that might have coated the surface of the hair.

Dry the hair completely, then sub-section the hair where your procedure will begin. (Sections should be chosen in regards to the density of the hair and the strength of the follicle of the hair strands. As an example, if a person has very sparse and weak hair follicles a larger section of hair must be used to support the additional weight that will be created by the hair extension. The style will also determine how large or small the sections should be.

The extension hair be it real or synthetic is prepared in a fixture such as a hackling comb, that will keep it organized. A section of extension hair, approximately 150 to 300 strands is separated out of the hackling comb and held at the distal end of the fingers of the operator. The ends of the extension hair should preferably be cut blunt about $\frac{3}{8}$th" from the operator's fingers.

The thermal molding adhesive is applied to the end of the extension hair that is being held between the fingers. The tip of the glued applicator is placed into the center of the extension hair end and glue is spread over the area approximately $\frac{1}{8}$th" down the strand from the ends.

A section of natural hair, having approximately the same amount or a slightly higher number of strands than the extension hair strands, is gripped in the fingers of the appliers left or right hand and held in the direction of the growth and weight (gravity) line. While the natural hair is in this position it is then pushed forwardly, allowing the natural hair to separate and establish an envelope or cavity. One places the extension hair within this natural hair cavity, or receiving site.

Figure 8:
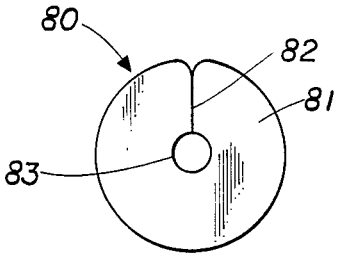
FIG. 8 is a perspective view of the round shield used to pre-prepare a section of natural hair to be treated according to this invention.

It is recommended that a shield be employed (see FIG. 8) which may be circular or heart shaped 80, having a main body portion 81, and a slot 82 that is directed inwardly to communicate with a throughbore 83 which shield is used to hold the section of natural hair being worked upon. The throughbore 82 should be about $\frac{1}{4}$" in diameter. This shield also services to prevent the adhesive from touching the scalp and the other sub-sections of the natural hair. The natural hair is pulled through the hole 82 by feeding it through the slot (separation). This allows the natural hair to be extended to remain separate and apart from the rest of the hair on the head.

Then the operator, using his/her thumb and forefinger pinches and rolls the natural and enveloped extension hair with the warm glue thereon, to create a bond and also to smoothly shape the adhesive.

Figure 6:
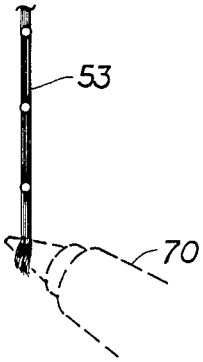
FIG. 6 illustrates the purging process.

During the short time period from glue application to extension the adhesive is cooled to a temperature that can be tolerated by ones fingers. The pinch and roll procedure is applied to the natural hair-extension hair combination to compress the hair and glue all together with as much compression as possible. This procedure will force out any air spaces that may arise during the bond forming process. When the adhesive has cooled the procedure is carried out for the next extension. After completion of the gluing process, it is recommended that the natural hair be purged of moisture, to ensure that long term adhesion will take place. This extra step may be carried out using the tip of the glue applicator gun or any other small surface to reheat each junction on the natural hair to rid the natural hair of moisture that could inhibit the action of the adhesive, which would cause poor bonding. The heat, slightly in excess of 212 degrees, is applied to the bond and then it i.e. the heat transfers to the natural hair. The operator should use caution to avoid remelting the rewarmed bond. See FIG. 6 which shows a heated instrument, here a hot melt glue gun 70 being so employed.

Alternatively the purging step can be carried out on each junction as it is made, rather than waiting till all are made and then going back to purge each and every junction.

After having attached as many extensions as necessary to create the look desired the combined hair will be cut, styled and dressed by the operator to please the client.

It is seen that the steps of the process comprise aligning the precombed or straightened tops and/or strands of supplemental hair with the natural hair of the customer. If the customer wants his or her hair that is thinning to be thickened, then the supplemental hair is placed reasonably close to the scalp, such that a large portion of the strands or tuft overlies the natural hair. If on the other hand the customer wants their own hair merely lengthened because they have short hair, then as shown in the illustrations, supplemental hair is placed a short distance from the proximal end of the natural hair such that when the junction is made, the overall length of the wearer's hair will seem longer. The hot melt or thermoplastic glue is applied to the newly positioned supplemental hair, and while still tacky the supplemental and natural hairs are rolled together between the fingers to bind one to the other.

By utilizing colored thermoplastic adhesive, and by carefully choosing the color of the supplemental hair, no visible distinction between the supplement and the natural hair can be made. Rolling the hair to bind and intertwine the supplemental hair together with the natural hair forms an almost invisible bond when the colored glue is employed. Since the thermoplastic glue is permitted to quickly harden, a step that takes anywhere from 5 to 25 seconds, the whole process moves along quickly.

While I have disclosed the use of hot melt glues for the instant process, it is also believed that certain waxes that have the same melting characteristics can also be employed herein.

Since certain changes may be made in the above hair extension process and the adhesive product used therein without departing from the scope of the invention involved herein, it is intended that all matter contained in the above description shall be interpreted as illustrative and not in a limiting sense.

I claim:

1. A process for extending human natural hair which comprises joining supplemental hair to natural hair to form an extension to natural hair, which process comprises:

a. dividing the natural hair into a multiplicity of sections each of which is to be subjected to an extension treatment;

b. providing a section of supplemental hair which has a distal end and a proximal end;

c. applying a thermal hot melt glue to the proximal end of the section of supplemental hair;

d. forming a receiving site in the natural hair for the supplemental hair;

placing the proximal end of the supplemental hair containing the hot melt glue into the receiving site; and f. adhesively binding the supplemental hair to the natural hair;

g. purging any moisture present from the area of the junction of the natural hair with the supplemental hair, wherein the step of adhesively binding the supplemental hair to the natural hair also includes the steps of g1. allowing the hot melt glue to cool to the touch;

g2. rolling the ends of strands of natural hair and supplemental hair together while the hot melt glue is still tacky to intertwine them; and g3. allowing the glue to harden.

2. The process of claim 1 including the step of trimming the supplemental hair to a blunt edge prior to placing it into position for adhesion.

3. The process of claim 1 including the further step h. styling the combined hair.

4. The process of claim 1 wherein the natural hair section and the supplemental hair section each contain from about 150 to 300 strands of hair.

5. The process of claim 1 wherein the moisture purging step is carried out by applying heat to the area of natural hair to which the supplemental hair has been attached after each junction is made, rather than after all junctions are made.

6. The process of claim 1 wherein the moisture purging is carried out by placing a heated end of a hot glue gun adjacent the natural hair to be moisture purged.

7. The process of claim 1 including the step of prepreparing colored hot melt glue approximately colored matched to the natural hair for use in the hot glue application step.

8. The process of claim 1 including the preliminary step of shampooing the natural hair prior dividing it into sections.

9. The process of claim 8 including the additional preliminary step of drying the shampooed hair prior to dividing it into sections.

10. A process for extending human natural hair which comprises joining supplemental hair to natural hair to form an extension to the natural hair, which process comprises:

a. dividing the natural hair into a multiplicity of sections each of which is to be subjected to an extension treatment;

b. providing a section of supplemental hair substantially color matched to the natural hair, said section having a distal end and a proximal end and containing from about 150 to 300 strands of hair therein;

c. applying a thermal hot melt glue to the proximal end of the section of supplemental hair;

d. forming a receiving site in the natural hair for the supplemental hair;

placing the proximal end of the supplemental hair containing the hot melt glue into the receiving site; and f. adhesively binding the supplemental hair to the natural hair by entwining strands of each with tacky hot melt glue and permitting the glue to harden; wherein the step of adhesively binding the supplemental hair to the natural hair also includes the steps of g1. allowing the hot melt glue to cool to the touch;

g2. rolling the ends of strands of natural hair and supplemental hair together while the hot melt glue is still tacky to intertwine them; and g3. allowing the glue to harden.

11. The process of claim 10 including the additional steps of g. purging nay moisture present from the area of the junction of the natural hair with the supplemental hair; followed by h. styling the combined hairs.

12. A process for thickening human natural hair which comprises:

a. dividing the natural hair into a multiplicity of sections each of which is to be subjected to an extension treatment;

b. providing a section of supplemental hair which has a distal end and a proximal end;

c. applying a thermal hot melt glue to the proximal end of the section of supplemental hair;

d. forming a receiving site in the natural hair close to the scalp for the extension hair;

e. placing the proximal end of the supplemental hair containing the hot melt glue into the receiving site such that a large portion of the supplemental hair overlies the natural hair; and f. adhesively binding the supplemental hair to the natural hair whereby, binding the supplemental hair to the natural hair also includes the steps of g1. allowing the hot melt glue to cool to the touch;

g2. rolling the ends of strands of natural hair and supplemental hair together while the hot melt glue is still tacky to intertwine them; and g3. allowing the glue to harden and then h. purging the moisture from the area of the natural hair where the supplemental hair will be attached.

13. The process of claim 12 including step of purging the moisture from the area of the natural hair where the supplemental hair has been attached.

14. The process of claim 12 including the further step of h. styling the combined hairs.

15. The process of claim 12 including the preliminary step of shampooing the natural hair prior to dividing it into sections.

* * * * *